US005326422A

United States Patent [19]

Kronseder

[11] Patent Number: 5,326,422

[45] Date of Patent: Jul. 5, 1994

[54] LABELLING MACHINE FOR LABELLING VESSELS

[76] Inventor: Hermann Kronseder, Regensburger Strasse 42, D-8404 Woerth, Fed. Rep. of Germany

[21] Appl. No.: 927,285

[22] PCT Filed: Mar. 8, 1991

[86] PCT No.: PCT/EP91/00438

§ 371 Date: Sep. 21, 1992

§ 102(e) Date: Sep. 21, 1992

[87] PCT Pub. No.: WO91/14625

PCT Pub. Date: Oct. 3, 1991

[30] Foreign Application Priority Data

Mar. 26, 1990 [DE] Fed. Rep. of Germany ..... 4009642

[51] Int. Cl.[5] ..... B65C 9/00

[52] U.S. Cl. ..... 156/566; 156/567; 156/571; 156/447; 156/DIG. 26; 74/567

[58] Field of Search ..... 156/566, 567, 568, 571, 156/DIG. 11, DIG. 26, DIG. 27, 447, 449; 74/567, 569, 813 R

[56] References Cited

U.S. PATENT DOCUMENTS 3,946,766 3/1976 Amigues ..... 74/567 X
4,911,285 3/1990 Rogall et al. ..... 156/567 X

FOREIGN PATENT DOCUMENTS

3323919A1 1/1985 Fed. Rep. of Germany .
3622179A1 1/1988 Fed. Rep. of Germany .

*Primary Examiner*—David A. Simmons
*Assistant Examiner*—James J. Engel, Jr.
*Attorney, Agent, or Firm*—Finnegan, Henderson, Farabow, Garrett & Dunner

[57] ABSTRACT

A labelling machine for treating vessels of different shapes or with different labels comprising a rotatingly drivable turntable with at least one labelling station disposed on its circumference with following wipe-on and pressure-applying elements, the turntable having rotary tables with one associated control element each, which cooperates optionally with one of several radial cams secured against rotation and disposed in axially staggered relationship in the direction of the rotary table axis, the control element associated to the rotary table and/or the radial cams are adjusted relatively to each other for change-over of one type of vessel and/or label to another one.

25 Claims, 5 Drawing Sheets

27
6
5
4
2
24
23
3
1
45
25

LABELLING MACHINE FOR LABELLING VESSELS

The invention relates to an labelling machine for treating vessels, in particular bottles.

It is customary that for applying labelling material to vessels, these vessels are pushed onto a rotary table, which is fastened to a rotatingly driven turntable of a labelling machine, the rotary table rotatably mounted on the turntable being controlled by means of a cam roller through a groove cam, which is customarily stationarily disposed below the turntable and contains a specific rotation programme determined by the profile of the groove cam. In particular in the case of shaped bottles or also in the case of costly labels as they are frequently used for alcoholic drinks, various rotation programmes, i.e. groove cams are required to carry out special movements upon the transfer of the labelling material and also upon wiping-on and/or pressure application. It is e.g. known to carry out a rotation of the rotary table opposite to the direction of rotation of the turntable at the moment of label transfer in the case of vessels having different diameters in the trunk and neck portions or a conical surface, while, in other cases, the vessel is again driven in a direction corresponding to the direction of rotation of the turntable during label transfer so as to be able to transfer labels being as long as possible to cylindrical surfaces. If standard labels are used, the vessel can also pass through the transfer station stationarily. The shape of the vessel and the label also determine the course of the wipe-on and pressure-applying path after the labelling station. Hitherto, a solution in this area was that the groove cam for each type of vessel or label to be processed receives a corresponding section, at which the brush-on bodies, sponge rollers, etc. are placed, while the remaining sections are passed without being used. This construction has the disadvantage that the necessary groove cam, and thus the rotary table, are of considerably greater dimensions due to the universal rotation programme than in the case of a machine only designed for a specific type of vessel or label.

Furthermore, a construction has already become known from DE-OS 33 23 919 in which two complete groove cams which may contain different rotation programmes are provided below the turntable for controlling a rotary table. This construction is disadvantageous inasmuch as each rotary table must be individually detached by hand from the turntable with its control means provided with a roller lever for the change-over from one rotation programme to the other one, lifted and introduced into the second groove cam. Rapid change-over of an machine from one type of vessel or label to another design deviating from it is hardly possible in this construction, above all since the groove cams are designed very accurately so as to avoid backlash so that the reintroduction of the cam rollers is above all problematical, it being possible that the groove cam can be damaged in the case of improper handling. Moreover, dirt may get into the groove cam upon the lifting of the rotary table from the turntable.

German Utility Model 87 08 031.1 shows a machine whose groove cam is equipped with controllable switches so that the cam rollers can optionally pass through various branches of the groove cam sectionwise. The susceptibility to wear of the switches, and the high wear of the cam rollers caused by the joints in the groove cam at this point is considered to be detrimental in this solution In addition to this, considerable damage both to the groove cams and the rotary table control can occur if the switch control fails.

In addition, the configuration latitude of the rotation programme is naturally greatly restricted in the two known devices due to the side-by-side arrangement of the groove cams as compared with a machine with only one groove cam due to the space being only limitedly available. The pivoting angle maximally available to the roller lever cannot be utilized to the same degree in the case of two cams in side-by-side relationship as this is the case in a groove cam being located approximately in the centre.

The invention is based on the object of providing a labelling machine for treating vessels with different shape and/or labels, which makes a user-friendly adaption of the rotary plate control in a change-over of the machine from one type of vessel or outfit to another one possible, several individual rotation programmes configurable independently from each other being available.

This object is obtained by providing a labelling machine for treating vessels of different shapes with different labels, in particular bottles, comprising a feeder, a rotatingly drivable turntable with at least one labelling station disposed at its circumference which is followed by wipe-on and pressure-applying elements and a discharge conveyor, the turntable comprising at least one rotatably mounted rotary table with an associated control member cooperating with a radial cam disposed in a fashion secured against rotation, characterized in that at least two different radial cams having in each case a rotation program for the rotary table which is complete for one revolution of the turntable are provided, which are disposed in axially staggered relationship in the direction of the axis of the turntable and that the control member associated to the rotary table and/or the radial cams can be adjusted relatively to each other for change-over from one vessel shape and/or label type to another one.

Due to the fact that several radial cams having a complete, individual rotation programme are provided according to the invention which are disposed axially staggered with respect to each other in the direction of the axis of the turntable, the radial cams and/or the control member associated to the rotary table being adjustable relative to each other, the design possibilities of the individual radial cams independently of the adjacent ones are largely unrestricted. Moreover, the clearance movement available to the control member of the rotary table can be fully utilized in each individual radial cam so that not too great a transmission ratio between the cam roller of the control element and the shaft of the rotary table must be selected. Thus, the clearance at the rotary table enlarged by the transmission and originating from the radial cam can be kept within fungible limits.

For the change-over of one type of vessel and/or label to another one, the control element of each rotary table can either be affixed to the turntable adjustably in axial direction, while the radial cams are of a stationary design or vice versa. The last-mentioned possibility permits a relatively simple constructional implementation. For this purpose, the radial cams can be disposed below the turntable in parallel to its plane of rotation in staggered relationship in such fashion that each radial cam can be optionally brought into the plane of rotation of the control elements and locked in this position. A common affixing of all radial cams to a single supporting body which is mounted axially displaceably to the axis of rotation of the turntable is especially advantageous. An especially compact construction results if the control cams are designed in each case in the form of a disk which has a defined outer contour. The disks can be affixed to a supporting body which is mounted displaceably along the bearing column of the turntable and is secured against rotation, e.g. by means of a tongue-and-groove connection.

In such a design, the control elements associated to the rotary tables can be firmly mounted on the lower side of the turntable. For the change-over of the rotation programme it must be possible to bring the control elements into a position which allows a displacement of the radial cams. All technical elements are suited for this, which are capable of bringing the control members out of engagement with the control cam and to bring them to bear again on them after the adjustment of the radial cam has been carried out, such as pneumatic cylinders. This can e.g. be achieved especially easily by the fact that the radial cams have a corresponding maximum outer diameter and the control members subsequently retain their position upon the reaching of this position.

Since in the case of the use of a radial cam with only one outer contour the cam roller of the control member is pressed against the radial cam by a spring element, the control element can be mechanically locked e.g. upon the reaching of the maximum outer diameter of the radial cam. If all control elements affixed to the turntable are held in this fashion, a radial cam having another rotation programme can be brought into the plane of rotation of the control elements without any problems. Due to the loosening of the locking, the cam rollers of the control elements can be brought to bear again on the radial cam. A special locking can be renounced if a gas spring is used as spring element to strain the cam roller, which can be deaerated. It is sufficient to deaerate all gas springs during one rotation of the turntable so that the control elements automatically stop with their cam rollers in the maximum position determined by the radial cam. After the adjustment of the radial cams, the gas springs can be acted upon by pressure again to bring the cam rollers to bear on the radial cam. The connection of all gas springs by a closed circular pipeline is especially advantageous so that a single connection is sufficient for pressure supply via a rotary distributor.

The control element of the rotary table, which scans the radial cam by means of a cam roller can e.g. be designed as a roller lever. Instead of this, the power transmission from the cam roller to the rotary table shaft can also be carried out via a push rod designed as toothed rack with a wheel gear turning the stroke movement into a rotational movement. Due to this constructional measure, the radial cams can also be designed relatively compactly in the case of larger, efficient machines, while the distance to the rotary table shaft is bridged by correspondingly dimensioned push rods. In addition to this, a transmission corresponding to the requirements can be effected in known fashion between the cam roller and the drive shaft of the rotary table. This is in particular frequently necessary in labelling machines for vessels with high-quality labels, since in the case of these vessels to be processed a rotation which is often necessary with a range of more than 360 degrees in both directions of the rotary table must be possible. The push rod designed as a toothed rack can be affixed to the lower side of the turntable aligned radially to the axis of the turntable in simple fashion and rotates with it during operation. A cylindrical cavity serving as a gas chamber can advantageously be integrated in the toothed rack, into which a stationary piston rod engages, by means of which pressure gas for the pressing of the toothed rack, and thus of the cam roller, against the radial cam can be supplied from the outside via a closed circular pipeline by means of corresponding hollow bores. Instead of this, the use of a flat spiral spring would also be possible.

There is a greater design latitude for the radial cams if the gas spring loading the cam roller is designed as double-acting cylinder, the same pressing the cam roller against the outer contour of a radial cam in normal operation and, during changeover, bringing the cam roller into a position optionally spaced from the radial cam so that the radial cam need not necessarily have a common, corresponding maximum outer diameter.

The supporting body guided displaceably along the bearing column of the turntable and receiving the radial cams can be actuated by means of a swivelling lever linked to the machine table, its position being fixable by an adjustable stop body with several corresponding stops.

Moreover, the invention can also be implemented with a forced control for both directions of rotation of the rotary table e.g. by means of a radial cam with two cooperating contours so that spring elements for pressing the cam rollers against only one existing cam contour could be omitted Due to the use of two toothed racks per rotary table which are opposite to each other with their toothing, with one cam roller each of their own, there is the possibility of achieving forced rotation in both directions of rotation. However, then two superimposed radial cams belonging together would be necessary per rotation programme, whose outer contours must be designed contrarily in such fashion that the two toothed racks cooperating in each case with a radial cam carry out a translatory movement in opposite directions, which is turned to a rotational movement by means of a gearwheel disposed between the two toothed racks and engaging in their toothing The gearwheel may be fastened directly to the drive shaft of the rotary table.

In the described embodiment the radial cams are suitably rigidly fastened, the control elements, i.e. the cam rollers, on the other hand, are adjustably fastened. For this purpose, the radial cams have a corresponding area, advantageously between vessel outlet and inlet, in which the superimposed outer contours and the cam rollers are in alignment so that upon the passing through this section the cam rollers can be displaced relative to the radial cams.

The displacement of the cam rollers can e.g. be effected by means of a controllable cam piece in the plane of rotation of the cam rollers, which is stationarily disposed on the circumference of the turntable. Thus, the control elements can be allocated to optionally different radial cams with the machine running, wherewith the simultaneous processing of vessels with different labels is possible in a labelling machine.

In the case of labelling machines with a large number of rotary tables, and thus automatically a large diameter of the turntable it is, on the other hand, more advantageous to dispose the radial cams directly below the area of rotation of the rotary tables. There is, in principle, again the possibility of disposing a radial cam with only one contour per rotation programme either on the radially inner or the radially outer side of the rotation path of the cam rollers and to bring them to bear in force-locked fashion by means of a spring element or to provide a radial cam with two contours per rotation programme for the form-fit guiding of the cam rollers.

The last-mentioned possibility can be implemented in a simple fashion with stationary, superimposed radial cams and adjustable control elements, the radial cams comprising a corresponding area in which the control elements or the cam rollers can be displaced in the fashion described above.

So that despite the different cam profile a power transmission to the drive shaft of the rotary table can be carried out, the contours of the radial cams disposed on both sides of the rotation path have a sufficiently great distance which is dimensioned in such fashion that the drive shafts of the rotary plates or the shafts carrying the cam rollers can engage through a common annular cavity without collision during an entire rotation up to the lowermost radial cam. Two cam rollers fastened on a carrier at a distance to each other are suitable for the simultaneous scanning of the contours of the radial cams extending on both sides of the rotation path. This support is pivotably mounted and drivingly connected with the drive shaft of the rotary tables. The support can be displaced relative to the radial cams to adjust another rotation programme.

Two examples of the invention are described in the following by means of the drawings in which.

Figure 1:
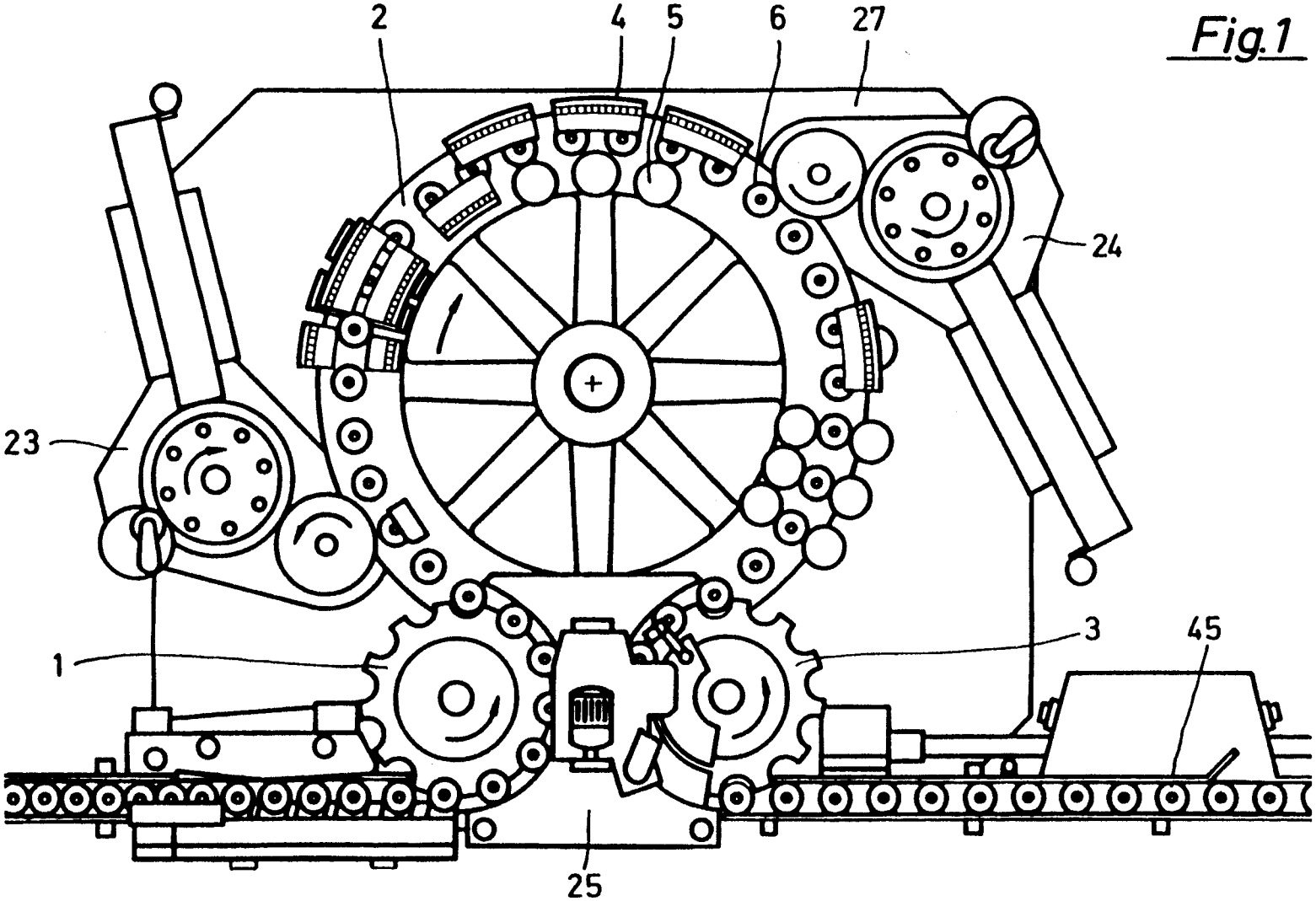
FIG. 1 is a top view of a labelling machine without its upper part.

As can be seen in FIG. 1, the vessels 45 to be labelled, which are supplied from the left by a suitable conveyor belt are first of all spaced apart from each other to the machine pitch and pushed onto turntable 2 supporting a plurality of rotary tables 6 in correct position by a feeder sheet 1 designed as rotating star. Before an incoming vessel 45 is released by the feeder 1, an axial clamping of the vessel between the rotary table 6 receiving the vessel bottom and a centering bell (not shown) controlled by a cam and lowered from above to the vessel head is carried out. For this purpose, the centering bells are customarily fastened in correct position to the rotary tables to an upper part rotating synchronously with the turntable, which is also not represented in FIG. 1. Immediately following this, the vessel receives for instance a trunk label and a tin foil for the neck of the bottles by means of a first outfitting station 23. Thereafter, the vessel passes through a brush-on and roll-on duct with stationary brushes 4 and sponge rollers 5, which are exchangeably disposed on the circumference of the turntable 2 These wipe-on and pressure-applying elements are exchanged as are the guide arcs and other elements of the machine in a case of the change of vessels or a change in the label, i.e these elements are individually combined Adequately adapted rotation programmes for the rotary table 6 must be available in this area. Then a back label can e.g. be additionally applied at a second outfitting station 24, which can again be wiped on or pressed on by means of brushes 4 and sponge rollers 5 on the way to the discharge wheel 3. The vessel is transferred from the turntable 2 to a discharge belt by means of discharge wheel 3 cooperating with a guide arc 25, and a finishing treatment of the tin foil by rotating brushes, etc. can additionally be carried out during this process.

Figure 2:
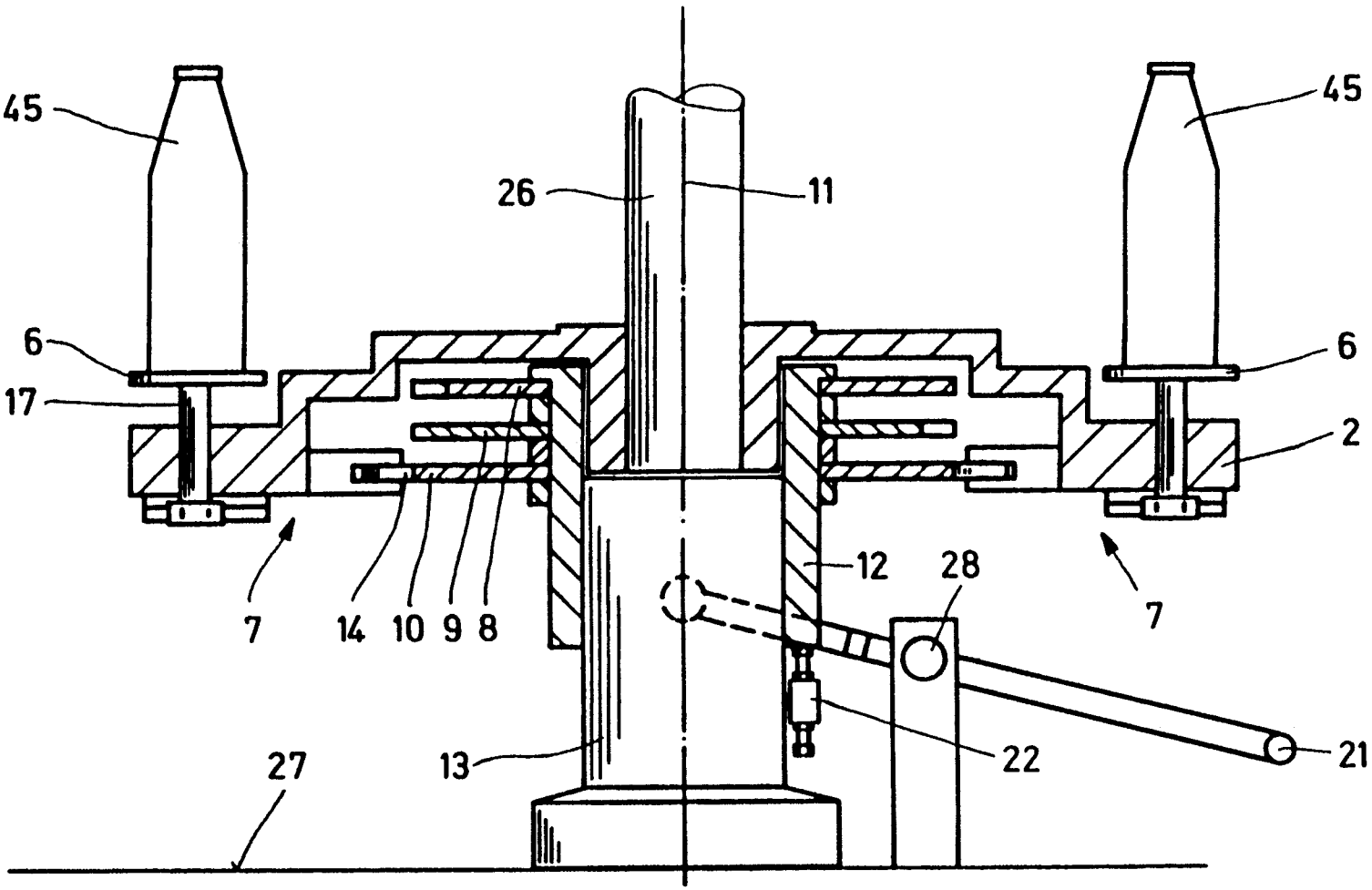
FIG. 2 is a vertical section through a turntable.

The control means producing the rotation of the rotary table 6 is schematically represented in FIG. 2. The turntable 2 is drivingly connected with the rotatingly driven central column 26, which is rotatably mounted in the bearing column 13 stationarily affixed to the machine table 27. The central column 26 extends up to the area below the machine table 27, which is not represented in greater detail, where the drive motor and the corresponding power transmission elements are positioned.

A supporting body 12 is guided axially displaceably on the casing surface of the bearing column 13, which is secured against twisting by a tongue-and-groove connection (not shown). Three radial cams 8, 9 and 10 are axially staggered in the direction of the axis 11 of the rotary table 2, i.e. rigidly connected among one another on the supporting body 12 in parallel to the rotation plane of the turntable 2. Moreover, the supporting body 12 may be displaced axially by hand on the bearing column 13 by a swivelling lever 21. For this purpose, the swivelling lever 21 is rotatably fastened to the supporting body 12 with its radially inner end and linked approximately centrally to a bearing bolt 28 fixed to the frame. The vertical position of the bearing body 12 and thus of the radial cams 8, 9 and 10 is determined by a stop body 22 fixed to the bearing column 13 on which the supporting body 12 is supported. The stop body 22 has in each case an adjustable screw for each radial cam, which forms the stop surface for the supporting body 12. The necessary stop surface can be brought into position by rotating the stop body after the lifting of the supporting body 12 by means of the swivelling lever 21. Due to this, each of the radial cams 8, 9, 10 can be brought into the constant rotation plane of the control elements 7 associated to the rotary tables 6, if required. The structure of the control element 7 can be seen better in FIGS. 3 and 4.

Figure 3:
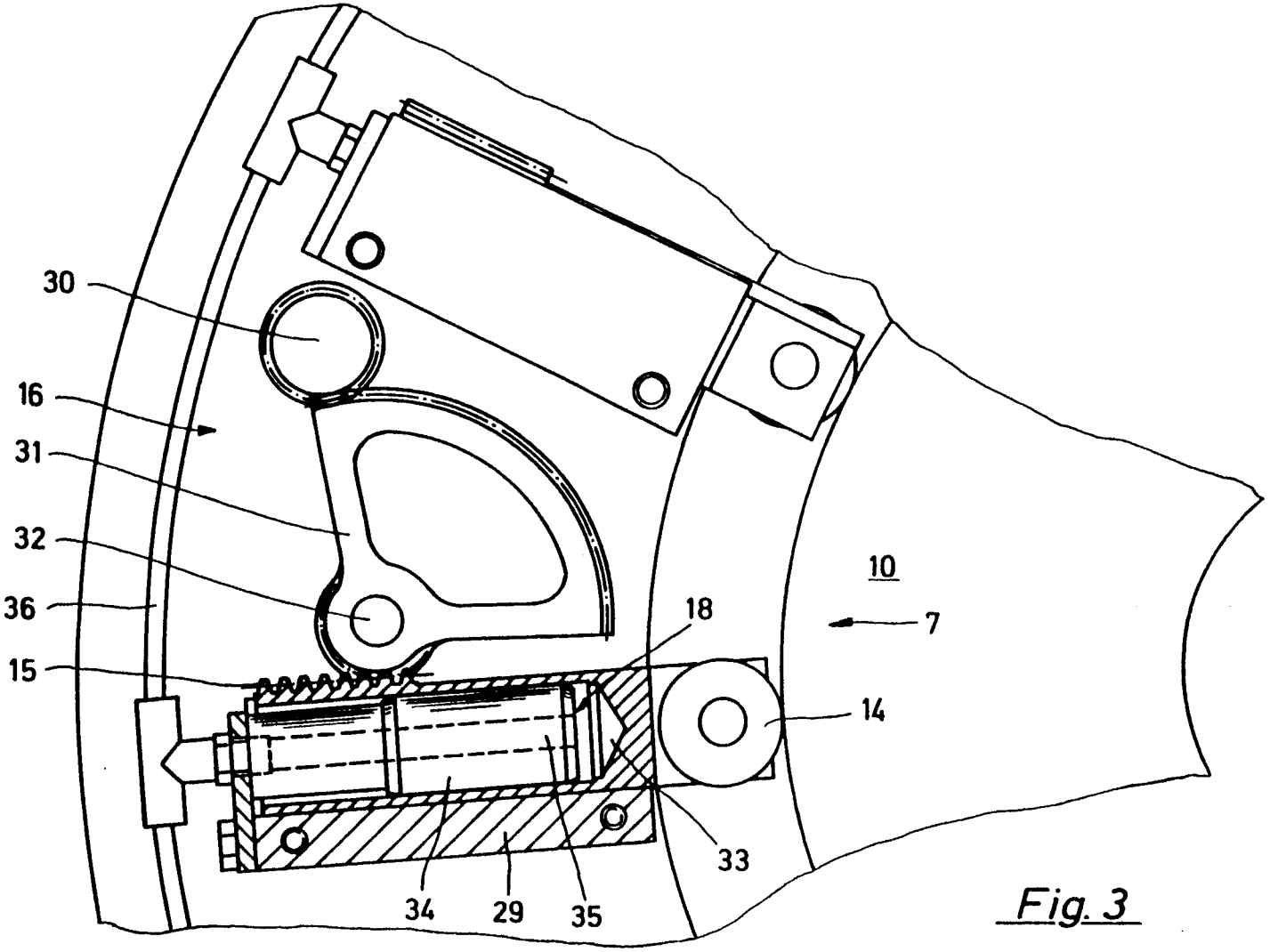
FIG. 3 shows a rotary table drive from the lower side of the turntable.

A control element 7 is represented in FIG. 3, which is seen from the lower side of the table. The cam roller 14 scanning the radial cam 10 is rotatably fastened to a displaceably mounted toothed rack is aligned radially to the turntable axis 11 at its end pointing towards the turntable axis.

Figure 4:
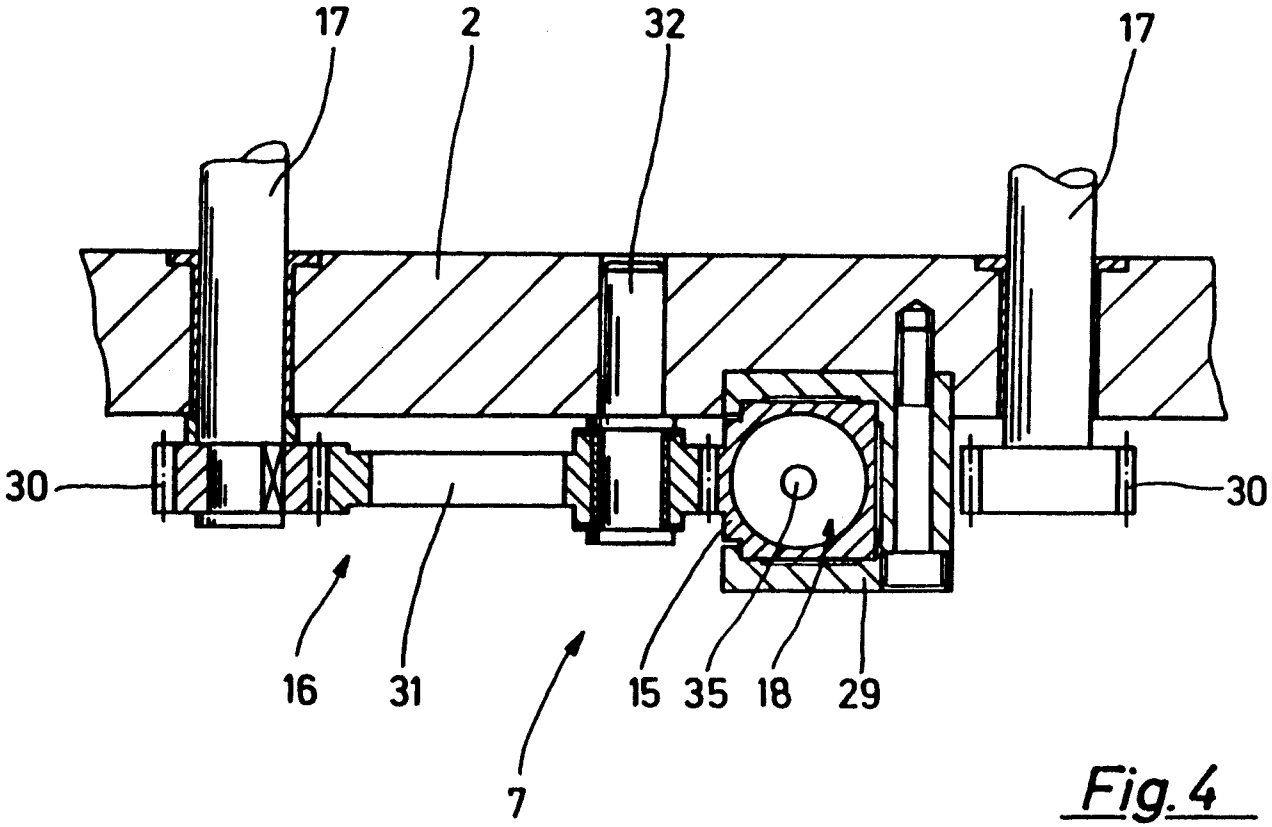
FIG. 4 is a vertical section through the rotary table drive represented in FIG. 3.

The toothed rack 15, cf. FIG. 4, is mounted in a sliding guide 29 affixed to the lower side of the turntable 2, the toothing of the toothed rack 15 engaging outwardly through a lateral slit in the sliding guide 29 and cooperating with the toothing of a gear means 16. In order to ensure an exact meshing of the toothings, the toothed rack 15 has an unround, preferably rectangular cross-section at its outer side and the sliding guide 29 has an unround, preferably rectangular cross-section at its inner side. The gear means comprises the gearwheel 30 affixed to the drive shaft 17 of a rotary table 6 and the stepped gear wheel 31 establishing the frictional connection to the toothed rack 15, which has two toothings located in one plane and having different reference circles, which form a gearing between the toothed rack 15 and the gearwheel 30. For this purpose, the stepped gearwheel 31 is mounted rotatably on a bolt 32 fastened to the turntable 2.

Since the radial cam 10, which can be seen in FIG. 3, only has one outer contour, the cam roller 14 must be pressed against the outer contour by means of a spring force. In the example shown, the spring force is applied by a gas spring 18 integrated in the toothed rack 15. A blind bore 33 extends into the end of the toothed rack 15 opposite to the cam roller 14, into which a piston 34 engages sealingly, which is rigidly affixed to the housing of the sliding guide 29. Due to the throughbore 35 in the piston 34 there is a connecting duct between the closed circular pipeline 36 connecting all adjacent pistons and the cavity in the toothed rack 15, which is formed by the blind bore 33 and the bottom of the piston 34. The closed circular pipeline 36 has a connection (not shown) to a reservoir with gas being under excess pressure. During operation, leakage losses must substantially only be compensated for by the closed circular pipeline 36.

If the labelling machine is to be changed over to another rotation programme, the connection between the reservoir and the closed circular pipeline 36 is at first interrupted by a corresponding valve, and the closed circular pipeline is opened towards the atmosphere. Thereupon, the turntable 2 is rotated once completely by the machine drive with the vessel supply locked so that all cam rollers 14 will adopt a common outer position in accordance with the maximum cam height and retain this position due to the depressurization of the closed circular pipeline 36 and friction.

All three radial cams 8, 9, 10 have a corresponding maximum diameter. Due to this, an adjustment of the radial cams without any problems is possible, which is effected by lifting the supporting body 12 by means of the swivelling lever 21, rotating of the stop body 22 and subsequent lowering of the supporting body 12 on the adjusted stop surface. With a renewed connection of the closed circular pipeline 36 with the reservoir containing pressure gas, all cam rollers 14 are again applied against the outer contour of the newly position radial cam.

The turntable 2 represented in FIG. 2 can be closed at its lower side by a cover (not shown) so that no dirt can penetrate into the gear and a circular oil lubrication can be used.

Figure 5:
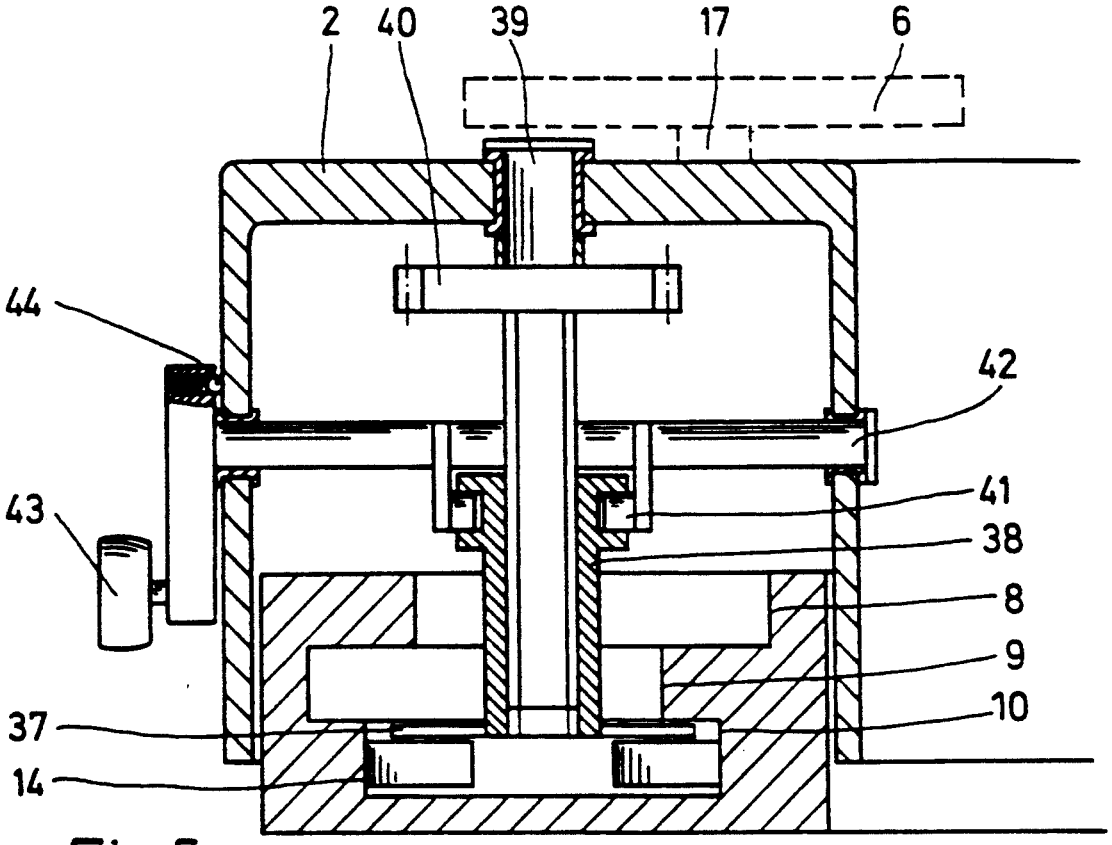
FIG. 5 is a vertical section through a part of a turntable according to a second embodiment.
Figure 6:
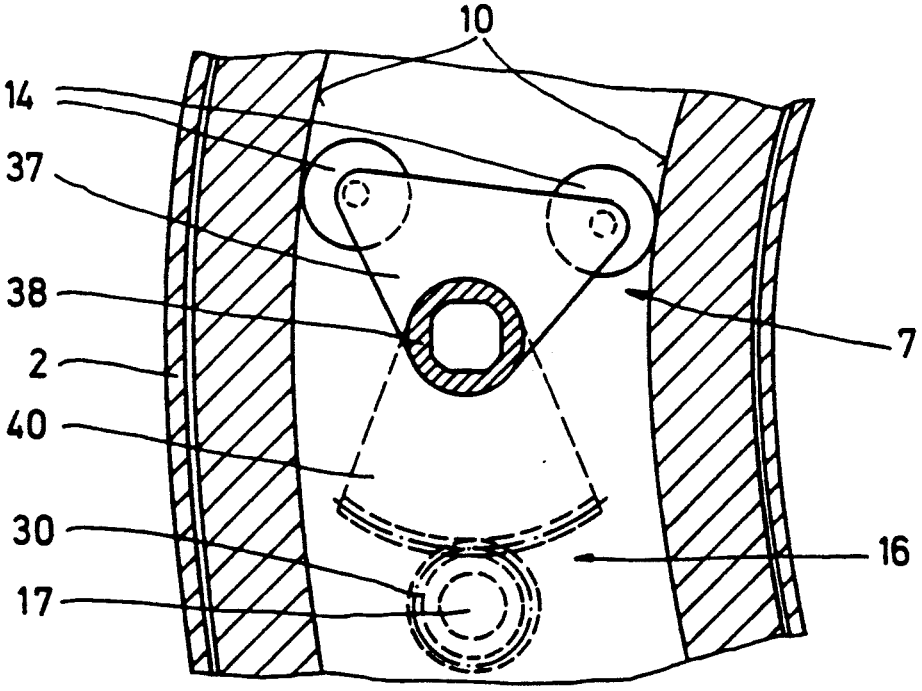
FIG. 6 is a horizontal section through the turntable of FIG. 5.

In the second embodiment represented in FIGS. 5 and 6, the rotary tables 6 mounted in the turntable 2 are force-controlled in form-fit fashion by two contour surfaces per radial cam. Due to this, a spring element as in the previously described example of embodiment for pressing the cam rollers 14 can be eliminated. The form-fit control is of particular of advantage in labelling machines in the upper performance range due to greater operational reliability.

Similarly as in a conventional labelling machine, the radial cams 8, 9, 10 controlling the rotational movement of the rotary tables 6 are stationarily disposed below the rotary path of the rotary tables 6. However, in the example of embodiment according to FIG. 5, three different control cams 8, 9, 10 are disposed rigidly one below the other, i.e. they are not vertically adjustable and secured against twisting. As opposed to conventional machines, however, two cam rollers 14 fastened to a support 37 in spaced relationship are provided in each case per rotary table, the cam rollers 14 being disposed leadingly or trailingly with respect to the swivelling axis of the support 37.

The distance of the two cam rollers 14 and of the abutting contours of a radial cam are dimensioned in such fashion that all superimposed radial cams 8, 9, 10 form an annular cavity, which is at least somewhat larger than the sliding sleeve 38 supporting the support 37 and the cam rollers 14, which is mounted axially displacably, but secured against rotation on the intermediate shaft 39. The intermediate shaft 39 is rotatably mounted on the lower side of the turntable fixed as to its height and supports a tooth segment 40 on its upper end, which meshes with the gearwheel 30 of the drive shaft 17 of the rotary table 6. Both are provided with a polygonal profile for torque transmission from the sliding sleeve 38 to the intermediate shaft 39.

The sliding sleeve 38 has an annular groove at its upper end, into which a fork 41 engages, which, in turn, is affixed to a control shaft 42 rotatably mounted in the housing of the turntable. The control shaft 42 supports a roller lever 43 at its end projecting radially outwardly from the housing of the turntable 2, with which a displacement of the cam rollers 14 into an area of the radial cams 8, 9, 10 is possible by means of the fork 41, in which the contours of the radial cams 8, 9, 10 correspond, i.e. are in alignment with each other. This area is suitably located between the discharge conveyor 3 and the feeder 1. A stationary, targetly controllable actuating means for adjusting the roller lever 43 can be disposed here. A spring-loaded ball locking means 44 is provided so that the roller lever 43 can retain its adjusted position during one rotation.

I claim:

1. In a labelling machine for labelling vessels of different shapes with different labels having a turntable adapted to be rotatingly driven about an axis and at least one labelling station for applying labels to said vessels located on the circumference of the path of rotation of the turntable, which station is followed by wipe-on and pressure-applying elements, means for feeding vessels to be labelled onto the turntable and for discharging labelled vessels therefrom, the turntable having at least one rotatably mounted rotary table on which said vessel sits while on said turntable, a stationary radial cam and a control member engagable with said cam and operatively connected to said rotary table for controlling rotary movement of the rotary table and the vessel sitting thereon during one revolution of the turntable, the improvement comprising at least two stationary radial cams, each having a different program of rotation for the rotary table for one revolution of the turntable, said radial cams being disposed in axially spaced relationship relative to the direction of the axis of the turntable, and means for optionally adjusting the engagement between said control member and radial cams to change-over the machine from one vessel type or one label type to another type.

2. The machine of claim 1, wherein the radial cams are located below the turntable and are disposed in planes parallel to the plane of rotation of the turntable.

3. The machine of claim 2, wherein each radial cam is optionally brought into engagement with the control member and locked in this position.

4. The machine of claim 3, wherein said radial cams are axially displaceably relative to the axis of the turntable.

5. The machine of claim 4, wherein the radial cams are affixed to an axially slidable supporting body.

6. The machine of claim 5, including a plurality of rotary tables and associated control members, the radial cams being disposed radially inward of the revolving path of the rotary tables and control members.

7. The machine of claim 6, wherein the supporting body is displaceably mounted around the axis of the turntable.

8. The machine of claim 7, wherein the axial position of the supporting body and the attached radial cams can be adjusted by means of a lever pivotable about a fixed pivot point, said supporting body being fixed in place by an adjustable stop body.

9. The machine of claim 6, wherein each of the radial cams is a disk with a defined outer contour.

10. The machine of claim 9, wherein the radial cams each have a maximum outer diameter.

11. The machine of claim 10, wherein each of the control members comprise a cam roller and a transmission gear.

12. The machine of claim 11, wherein the transmission gear comprises a toothed rack guided on a lower side of the turntable and aligned radially with the axis of the turntable, which rack supports the cam roller on its end directed towards the axis.

13. The machine of claim 12, wherein each rotary table is mounted on a shaft rotatably supported in the turntable and the toothed rack rotates the drive shaft of the rotary table via a wheel gear.

14. The machine of claim 11, wherein the cam roller is pressed against the outer contour of the associated radial cam by means of a spring element.

15. The machine of claim 14, wherein the spring element is spiral spring.

16. The machine of claim 14, wherein the spring element is a gas spring.

17. The machine of claim 16, wherein the gas spring of each control member is connected with each other and to a source of pressurized gas.

18. The machine of claim 17, wherein means for depressurizing the gas springs.

19. The machine of claim 11, wherein the outer contour of all radial cams reaches its maximum distance from the axis of the turntable in the path or rotation of the turntable between where the vessels are fed onto the tables and where they are discharged therefrom.

20. The machine of claim 19, including means for locking the cam rollers in position when they are at their maximum distance from the axis of the turntable.

21. The machine of claim 16, wherein the gas spring is a double-acting cylinder, said cylinder pressing the cam roller against the outer contour of a radial cam is normal operation and bringing the cam roller into a position spaced from the outer contour of radial cam during change-over.

22. The machine of claim 1, including means for bringing the control member out of engagement with the radial cams during change-over.

23. The machine of claim 2, wherein the radial cams are stationarily disposed in the revolving area of the turntable and the control member is optionally brought into engagement with one of the radial cams.

24. The machine of claim 23, wherein the radial cams have a joint section with corresponding cam profile in which the contours of the radial cams are in alignment.

25. The machine of claim 24, wherein the control member comprises a cam roller and a transmission gear and the adjustment of the engagement of the cam roller with a radial cam is carried out by means of a controllable actuating means located at the joint section.

* * * * *

UNITED STATES PATENT AND TRADEMARK OFFICE

CERTIFICATE OF CORRECTION

PATENT NO. : 5,326,422
DATED : July 5, 1994
INVENTOR(S) : Hermann Kronseder

It is certified that error appears in the above-indentified patent and that said Letters Patent is hereby corrected as shown below:

Claim 18, column 10, line 4, change "wherein" to --including --.

Claim 19, column 10, line 8, change "or" to --of--.

Claim 21, column 10, line 16, change "is" to --in--.

Signed and Sealed this

Twenty-ninth Day of November, 1994

*Attest:*

Bruce Lehman

BRUCE LEHMAN

*Attesting Officer*

*Commissioner of Patents and Trademarks*